United States Patent [19]

Schlosberg et al.

[11] 4,059,410

[45] Nov. 22, 1977

[54] METHOD FOR THE PREPARATION OF NONCAKING COALS FROM CAKING COALS BY MEANS OF ELECTROPHILIC AROMATIC SUBSTITUTION

[75] Inventors: Richard H. Schlosberg, New Providence; Martin L. Gorbaty, Fanwood, both of N.J.; Robert J. Lang, Baytown, Tex.

[73] Assignee: Exxon Research & Engineering Co., Linden, N.J.

[21] Appl. No.: 700,104

[22] Filed: June 28, 1976

[51] Int. Cl.[2] ..... C10L 9/02

[52] U.S. Cl. ..... 44/1 R

[58] Field of Search ..... 44/1 R, 1 C; 208/9

[56] References Cited

U.S. PATENT DOCUMENTS

| | | | |
|---|---|---|---|
| 3,357,896 | 12/1967 | Gasior et al. | 44/1 R |
| 3,687,838 | 8/1972 | Seitzer | 208/9 X |
| 3,728,252 | 4/1973 | Pitchford | 208/9 X |

*Primary Examiner*—Carl F. Dees

*Attorney, Agent, or Firm*—Joseph J. Allocca; E. A. Forzano

[57] ABSTRACT

A method for the preparation of and pretreatment of coal, which coal will not cake when subjected to standard coal conversion processes, which method comprises the steps of electrophilically aromatically substituting the coal yielding alkylated or acylated products thereby.

15 Claims, No Drawings

METHOD FOR THE PREPARATION OF NONCAKING COALS FROM CAKING COALS BY MEANS OF ELECTROPHILIC AROMATIC SUBSTITUTION

In general, the electrophilic aromatic substitution reaction practiced on the subject coal constitutes either alkylation or acylation. Alkylating agents are olefins, paraffinic or cycloparaffinic alkyl halides, the hydrocarbon portion having a carbon number of from $C_2$–$C_{20}$. The halide may be chloride, bromide, fluoride, etc. In addition to halides, alcohols may also be utilized, which have carbon numbers of from $C_1$–$C_{20}$ and are either straight or branch chained.

Standard acylating agents are those materials which have an acyl group, i.e.

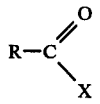

wherein X may be a halide or

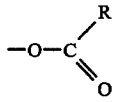

(called an anhydride).

When using either of the above, it is necessary to also use an acid catalyst to facilitate the reaction. The acid catalysts used are broadly characterized as electron acceptors and may be referred to as Friedel-Crafts catalysts.

In addition to the alkylation and acylation reactions outlined above, it is also possible to treat coals with carbon monoxide in the presence of a Friedel-Crafts catalyst. This yields an electrophilically aromatically formylated coal.

Any coal conversion process which utilizes a fixed bed reactor, which depends upon moving grates, or utilizes a fluidized bed requires a sized coal, which will not cake, since caking tends to reduce overall surface area, and increase agglomerating tendency, thus increasing the average size of each coal particle. Caking will also tend to jam any mechanically moving parts of the system used, such as grates. In addition, caking tends to cause defluidization of a fluidized bed.

The importance of obtaining a noncaking coal can be better understood by reference to the following typical coal conversion processes which will be of great importance in the continuing effort to obtain gaseous and liquid products from coal as crude oil and petroleum substitutes.

The Lurgi process is a commercially available process for coal gasification. Lurgi employs a downward moving fixed bed of coal at 1200°–1900° F and 300–500 psig. A rotating mechanical device is used to control solids flow and because of this, the reactor diameter is limited to about 13 feet. It can handle caking coals but only with some difficulty.

Fluidized bed and moving bed gasification and hydrogasification process such as Bi-gas, Hygas, Wellman-Galusha, Hydrane, Synthane, U-Gas, Winkler, as well as Lurgi which is a moving bed, all require noncaking coals, i.e. coals which remain finely divided, nonagglomerated, non-plastic in the course of the conversion process.

To prevent problems generated by plugging in conversion systems where fluidized beds are used, nonagglomerating (noncaking) coals are needed. These materials will not pass through a plastic state upon pyrolysis but will essentially retain their initial physical structure.

Bituminous coals of the Illinois #6 seam are caking coals because they go through a plastic state in the course of pyrolysis. The instant invention shows that a pretreat of this coal under acylation or alkylation conditions leads to a hydrocarbon solid whose structure has been altered to the extent that this caking property is destroyed.

The alkylated or acylated material can be pyrolyzed directly or extracted with a suitable solvent (e.g. pyridine, quinoline, phenol, tetralin, hydrocarbon oils, morpholine, ethylenediamine, etc.) followed by pyrolysis. In the rapid pyrolysis step many of the alkyl groups will be cleaved and can be recovered.

Alkylation and acylation can be broadly characterized as electrophilic substitution reactions. More particularly, the alkylation or acylation of coal can be characterized as an electrophilic substitution wherein the aromatic carbon-hydrogen bond, e.g. aromatic C—H of the coal structure, is the site of primary attack by the alkylating or acylating agent.

Alkylation and acylation are well known and well documented reactions. The use of coal as the material to be alkylated or acylated should not change the chemistry of the reaction or the manner in which the reaction proceeds. Consequently, coal can be alkylated or acylated at conditions amenable to alkylation or acylation of many other materials, particularly those of an aromatic nature. Nevertheless, the coal should be in a finely ground state, further elaborated upon hereinbelow, to facilitate contact with the alkylating or acylating reagent which may be either a liquid or a gas at reaction conditions. Generally, any compound capable of being an acylating agent or an alkylating agent can be employed.

In the case of acylation, the reagent may be any compound containing an acyl group, that is

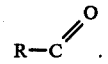

Thus, acyl halides, e.g. iodide, bromide, chloride, or fluoride, can be employed as well as haloacyls, e.g., phosgene, and compounds generally of the formula

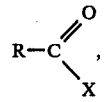

wherein X may be a halogen (i.e. iodine, bromine, chlorine, fluorine),

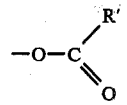

(as in an anhydride), and R and R′ may be alkyl, cycloalkyl, aryl cycloalkyl or arylalkyl. Acylation also includes the reaction of CO in the presence of a Friedel- Crafts catalyst to synthesize aldehydes, i.e. formylation. Prior art has shown that, by this method, CO is introduced into aromatic molecules under the influence of typical Friedel-Crafts strong acid catalysts. The number of carbon atoms in the acyl containing compound can vary widely, such as $C_2$ or larger, preferably $C_2$ to $C_{20}$. Examples of acyl containing compounds are acetyl chloride, lauroyl chloride, benzoyl chloride, etc. Additionally, carbon monoxide, although not an acyl compound, per se, can be employed, as previously mentioned, in the formylation reaction.

In the case of alkylation, the reagent can be olefinic, paraffinic, cycloparaffinic, or an alkyl halide. The size of the reagent is not critical, although the larger the chain the greater the benefit per reaction site insofar as subsequent utilization of the coal is concerned. Preferably, $C_2$–$C_{20}$ olefins are employed, $C_2$–$C_{20}$ paraffins, and compounds having the general formula $R^2X$ wherein X is any halogen and $R^2$ can be alkyl, cycloalkyl, aryl cycloalkyl, or arylalkyl and more preferably, having from 1–20 carbon atoms. Still more preferably are $C_2$–$C_8$ alkyl halides and $C_2$–$C_8$ olefins, e.g., ethylene, propylene, butylene, pentylene, butyl chloride, propyl bromide, ethyl chloride, ethyl iodide, etc.

Alcohols can also be employed as alkylating agents although a greater than stoichiometric amount of catalyst is usually required when an alcohol is the alkylating reagent. $C_1$–$C_{20}$ straight chain or branched compounds can be employed. Thus, in the formula $R^2X$, X can also be an OH (hydroxyl) group.

The use of acyl halides or alkyl halides requires the use of an acid catalyst to promote the desired reaction. Catalysts that can be employed are broadly characterized as electron acceptors and may be commonly referred to as Friedel-Crafts catalysts. Examples of such catalysts are as follows:

1. Acidic halides such as Lewis acids, typified by metal halides of the formula $MX_n$ wherein M is metal selected from Groups IIA, IIB, IIIA, IIIB, IVA, IVB, VA, VB, VIB, or VIII of the Periodic Chart of the Elements, X is a halide from Group VIIA, and $n$ is an integer from 2 to 6. Further examples of these materials are the fluorides, chlorides, or bromides of aluminum, beryllium, cadmium, zinc, boron, gallium, titanium, zirconium, tin, lead, bismuth, iron, uranium, molybdenum, tungsten, tantalum, niobium, etc.

Preferred materials are aluminum chloride, aluminum bromide, zinc chloride, ferric chloride, antimony pentafluoride, tantalum pentafluoride, boron trifluoride, etc. Additionally, these materials may be promoted with cocatalysts that are proton releasing substances, e.g. hydrogen halides, such as hydrogen chloride. Thus, a particularly preferred catalyst is HCl or $AlCl_3$/HCl.

2. Metal alkyls and halides of aluminum, boron, or zinc, e.g., triethyl aluminum, ethyl aluminum dihalide, and the like.

3. Protonic acids commonly referred to as Bronsted acids and typified by sulfuric acid, hydrofluoric acid, hydrochloric acid, hydrobromic acid, fluorosulfuric acid, phosphoric acid, alkane sulfonic acids, e.g., methane sulfonic acid, trifluoroacetic acid, aromatic sulfonic acids such as para-toluene sulfonic acid, and the like, preferably HF or HCl.

4. Acidic oxides and sulfides (acidic chalcides) and modified zeolites, e.g., $SiO_2/Al_2O_3$. Additionally, these materials may be promoted with cocatalysts that are proton releasing substances, e.g., hydrogen halides such as hydrogen chloride and hydrogen fluoride. Since many sub-bituminous coals and bituminous coals contain significant amounts (as much as 5–7% by weight) of clays and acidic oxides, the use of clays and acidic oxides either by promotion with acids (e.g. HCl, HF) or alone is particularly preferred.

5. Cation exchange resins.

6. Metathetic cation forming agents. Preferred catalysts are Lewis acids, Bronsted acids and acidic oxides.

When the metal halides are employed, normal precautions should be taken to avoid preferential reaction and consequently catalyst deactivation, by combination with water. Thus, the coal is normally dried and should be substantially moisture free, that is, less than 4 wt. % moisture, based on coal, preferably less than 2 wt. % moisture. Alternatively, the acyl halide can be mixed with the metal halide catalyst prior to contacting with the coal and thereby inhibit any deactivation of the metal halide catalyst due to reaction with water.

The metal halide can be utilized in any desired amount, e.g., catalytic amounts, based on the acylating agent. Thus, about 100 to 150 mol % metal halide, preferably 100 to 120 mol %, and more preferably 100 to 105 mol % metal halide can be employed.

Acylation conditions are not critical and temperatures may range from about −20° to 200° C, preferably 0° to 150° C, while pressures may range from 0 to 2000 psig, preferably atmospheric to 1500 psig. Contact times may also vary widely, e.g., a few seconds to several days, preferably about 10 seconds to 300 minutes, most preferably, 1 minute to three hours.

Alkylation is similarly accomplished by the use of known techniques. Alkylation is effected catalytically. It is believed that in some cases, the mineral matter present in some coals may also act as a catalyst for alkylation.

Again, moisture should be avoided and the presence of water should be kept below the amounts mentioned above. Additionally, when olefins are employed, care should be taken to avoid conditions that could lead to olefin polymerization, e.g. lower temperatures. Preferably $C_2$ and terminal olefins are used and preferred catalysts are hydrogen fluoride, boron trifluoride, phosphoric acid, or acid promoted coal mineral matter. Generally, however, temperatures may range from about 0° to 300° C, preferably 25° to 250° C with pressures ranging from about 0 to 2000 psig, preferably 0 to 1500 psig and contact times again ranging from a few seconds to several hours, preferably about 10 seconds to about 60 minutes.

A variety of alkylation catalysts can be employed and these can be known and reported catalysts such as the Friedel-Crafts catalysts mentioned above, particularly the Lewis acids, or strong acids such as hydrofluoric acid, hydrochloric acid, sulfuric acid, fluorosulfuric acid, trifluoroacetic acid, methane sulfonic acid, and the like, as well as mixtures of Lewis acids with Bronsted acids for example, as shown in the U.S. Pat. No. 3,708,583. The amount of catalyst, if any, employed can range from 0.05 to 50 wt. % based on coal, preferably 0.05 to 10 wt. %.

At the conclusion of the alkylation or acylation reaction, the treated coal is separated from the reaction mixture by conventional techniques and made free of any acid catalyst, as by washing. As mentioned above, if desired, the alkylation or acylation step can then be repeated to maximize the amount of reagent taken up by the coal.

Generally, any type of caking coal can be utilized in the process of this invention, such as bituminous. The coal is generally ground to a finely divided state and will contain particles less than about ¼ inch in size, preferably less than about 8 mesh, more preferably less than about 100 mesh. It is believed that the degree of alkyl group radical take-up by the coal may be a function of coal surface area. Consequently, it is desirable to expose as much coal surface area as possible without losing coal as dust or fines or as the economics of coal grinding may dictate. Thus, particle sizes of less than about 8 mesh to greater than about 325 mesh are preferred and particle sizes of less than about 100 mesh to greater than about 325 mesh are more preferred. The coal can be dried by conventional drying techniques, for example, by heating to about 100° to 110° C, but below temperatures that might cause other reactions when susceptible coals are employed. The dried coal can then be fed to the alkylation or acylation zone either as a solid or slurried in a suitable solvent, e.g., paraffins such as heptane, hexane, cyclohexane, carbon disulfide, halogenated paraffins such as carbon tetrachloride, chloroform, etc., although a solid feed is preferred since solvents tend to reduce the activity of catalysts employed in alkylation or acylation of coals.

Subsequent to the alkylation/acylation reaction, the product, hereafter referred to as "activated coal," is optionally extracted with solvents.

The data from rapid pyrolysis (1200° F) experiments are shown in the attached table. The experiments were directed to determining the effect of alkylation on the caking or agglomerating properties of the coals.

Method: Approximately one gram samples of Illinois #6 coal which had been comminuted, were placed in a pyrex pyrolysis vessel and the pyrolysis carried out at about 1200° F (about 650° C). After gas evolution ceased, the vessel was cooled and weighed. The solid was removed, its physical condition noted, and was also weighed. Thus were coke make, liquid make and, by difference gas make determined.

Caking and Noncaking Coal

The physical condition of each of the pyrolysis cokes is shown in the table. Note that raw Illinois #6 coke was agglomerated, (Sample 6) that is, before coke formation, the coal softened, causing particles to agglomerate. In some cases, the coal becomes a plastic mass. In fluidized systems now being worked on, agglomeration is not desirable and for fixed bed processes, e.g., Lurgi Gasification, agglomeration can be tolerated only with difficulty.

It can be seen that a whole alkylated coal sample, i.e., not extracted, (Sample 5) and an alkylated coal extraction residue (Sample 4) did not agglomerate under the same conditions that raw Illinois #6 coal did, and one could conclude that the alkylation reaction does suppress caking.

It is seen that benzene extraction is not responsible for this suppression since a sample of untreated benzene extracted coal agglomerates just as the unextracted coal does (compare Sample 2 with Sample 6). A physical mixture of aluminum chloride and Illinois #6 coal (Sample 3) heated to 100° C for 2 hours (alkylation conditions) agglomerated during rapid pyrolysis; however, the same mixture heated in a benzene medium (Sample 1) did not agglomerate. It is clear from the former result that just contacting $AlCl_3$ with coal is not sufficient to destroy the agglomerating property. This is in contrast to teachings in the literature that contacting of high volatile bituminous coals with $BF_3$ will suppress caking (Chakrabartty and Berkowitz, Fuel 51, 44 (1972)). This implies that not every acid catalyst used in the alkylation reaction is effective for destroying caking properties. Furthermore, it has been reported that thermally alkylated coals and their extracted residues not only maintained their caking properties, but actually showed a lowering of softening point and increase in contraction compared to untreated coals (C. Kröger, Forschungberichte Des Landes Nordrhein-Westfallen, No. 1488, pp 9–39 (1965)). The thermal reactions were carried out at 300°–360° C, compared to acid catalyzed alkylations at about 100°–150° C.

In summary, it is clear that electrophilic aromatic substitution results in a coal product which does not cake or agglomerate.

EXAMPLE 1 (Sample 5 of Table I)

Approximately 1 gram of alkylated Illinois #6 coal was used from a sample prepared in the following manner: A 128 ml Paar autoclave was charged with 7.0 g of Illinois #6 Coal comminuted to pass a 200 mesh screen, 3.0 g aluminum chloride and 8.0 g isopropyl chloride. After cooling using an external ice bath, 230 psig of hydrogen was charged to the system and the system was warmed to 25° C. The autoclave was heated on a steam bath for about 1 hour, allowed to cool to room temperature, vented, water washed and vacuum oven dried to yield 8.0 g of product.

| | | | |
|---|---|---|---|
| Product | % H = 5.68 | % C = 68.25 | H/C = 0.992 |
| Starting Coal (as analyzed) | % H = 4.81 | % C = 68.80 | H/C = 0.833 |

One gram of this pulverized material was heated in a pyrolysis apparatus to 1200° F in a 1.5 minute period to yield a powder. Untreated Illinois coal agglomerated under identical conditions, to yield a monolithic button.

| | Alkylated Coal | Illinois #6 Coal |
|---|---|---|
| % Coke | 57.8 | 62.0 |
| % Liquid | 24.7 | 23.4 |
| % Gas (by difference) | 17.5 | 14.7 |

TABLE 1

| All Illinois #6 Coals Sample | Akylation Conditions | Coke Condition |
|---|---|---|
| 1* | $AlCl_3$, benzene 150° C for 19 hrs. | Powder |
| 2* | No catalyst. Benzene extracted at 80° C for 48 hrs. | Agglomerated |
| 3 | $AlCl_3$ 100° C for 2 hrs. | Agglomerated |
| 4* | $AlCl_3$ 1-Chlorodecane 150–200° C for 4 hrs. | Powder |
| 5 | $AlCl_3$, 2-chloropropane 95° C for 1 hr. | Powder |
| 6 | None | Agglomerated |

*These samples were extracted with benzene before pyrolysis.

EXAMPLE 2

Approximately 100 milligrams of each of three coal samples were placed in small alumina boats. These samples were (A) a raw Kentucky HV Bituminous coal comminuted to pass a 100 mesh screen, (B) an alkylated sample of coal (A), and (C) sample of coal (A) alkylated in the presence of hydrogen.

| Sample | % H | % C | H/C |
|---|---|---|---|
| A | 5.21 | 73.52 | 0.844 |
| B | 5.03 | 63.39 | 0.946 |
| C | 5.40 | 71.92 | 0.895 |

These sample boats were placed in a sample holder. A large tube furnace was heated to 1200° F (650° C). The samples were placed into an alumina tube fitted with a thermocouple and through which 2400 cc/min nitrogen was flowing. The tube was placed into the furnace, brought to 1200° F (650° C) over a 15 minute period and held at that temperature, for 4 to 5 minutes. The tube was then cooled to below 200° C and the samples removed. The raw coal underwent significant expansion and caking to produce a gray friable material. Samples B and C showed no caking in that they were removed as free flowing powders.

What is claimed is:

1. A process for the preparation of noncaking coal from caking coal which comprises the step of electrophilically aromatically substituting the caking coal yielding a product thereby which is a noncaking coal.

2. The process according to claim 1 wherein the electrophilic aromatic substitution reaction practiced on the coal comprises alkylation.

3. The process according to claim 1 wherein the electrophilic aromatic substitution reaction practiced on the coal comprises acylation.

4. The process according to claim 2 wherein the alkylation step comprises subjecting the coal to an alkylation reagent selected from the group consisting of olefins, paraffins, organohalides, wherein the organo group is an alkyl, cycloalkyl, arylcycloalkyl or arylalkyl radical and the halogen is selected from the group consisting of fluorine, chlorine, bromine and iodine, and organo hydroxyls wherein the organo group is as defined previously.

5. The process of claim 3 wherein the acylation step comprises subjecting coal under appropriate conditions to an acylation reagent selected from the group consisting of CO, haloacyls and compounds having the formula

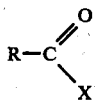

wherein R is an alkyl, cycloalkyl, arylcycloalkyl or arylalkyl radical and X is a halogen or anhydride derivative in the presence of a catalyst.

6. The process of claim 1 wherein the electrophilic aromatic substitution reaction step practiced on the coal is conducted in the presence of a catalyst.

7. The process of claim 5 wherein the acylation step is practiced on coal using carbon monoxide as acylating agent further comprises the step of using a hydrogen halide catalyst.

8. The process of claim 2 wherein the alkylation step is conducted by subjecting the coal under appropriate conditions to an alkylation reagent selected from the group consisting of organohalides and organo hydroxyls, wherein the organo radical is selected from the group consisting of $C_2$14 $C_{20}$ alkyl, cycloalkyl, arylcycloalkyl and arylalkyl radicals and halogen is selected from the group consisting of chlorine and bromine in the presence of a catalyst.

9. The process of claim 6 wherein the catalyst is selected from the group consisting of Lewis acids.

10. The process of claim 9 wherein the Lewis acid catalyst is selected from the group consisting of aluminum chloride, aluminum bromide, zinc chloride, ferric chloride, boron trifluoride.

11. The process of claim 1 wherein the electrophilic aromatic substitution step practiced on coal comprises:

1. contacting the coal with an electrophilic aromatic substitution reagent at a pressure and for a time sufficient to cause the coal to react with the reagent;
2. washing the treated coal to remove substantially all of the unreacted reagents; and
3. repeating steps (1) and (2).

12. The process of claim 1 wherein the caking coal is selected from the group consisting of Illinois #6 and Kentucky high volatile bituminous coals.

13. The process of claim 2 wherein the alkylating agent is a $C_2$–$C_8$ alkyl halide.

14. The process of claim 2 wherein the alkylating agent is a $C_2$–$C_8$ olefin.

15. The process of claim 3 wherein the acylating agent is a $C_2$–$C_{20}$ acyl halide.

* * * * *